US010297113B2

(12) United States Patent
Czapkiewicz et al.

(10) Patent No.: US 10,297,113 B2
(45) Date of Patent: May 21, 2019

(54) GAMING SYSTEMS AND METHODS FOR OFFERING A PLAYER MULTIPLE GAMES

(71) Applicant: Novomatic AG, Gumpoldskirchen (AT)

(72) Inventors: Bartholomeus Czapkiewicz, Guntramsdorf (AT); Johannes Wilms, Vienna (AT)

(73) Assignee: Novomatic AG, Gumpoldskirchen (AT)

( * ) Notice: Subject to any disclaimer, the term of this patent is extended or adjusted under 35 U.S.C. 154(b) by 16 days.

(21) Appl. No.: 15/403,014

(22) Filed: Jan. 10, 2017

(65) Prior Publication Data

US 2018/0197376 A1 Jul. 12, 2018

(51) Int. Cl.
*G07F 17/32* (2006.01)

(52) U.S. Cl.
CPC ..... *G07F 17/3262* (2013.01); *G07F 17/3209* (2013.01); *G07F 17/3211* (2013.01); *G07F 17/3244* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 9,336,646 | B2 | 5/2016 | Pirvu | |
| 9,779,584 | B1 | 10/2017 | Czubak | |
| 2002/0183105 | A1* | 12/2002 | Cannon | G07F 17/32 463/16 |
| 2004/0166940 | A1* | 8/2004 | Rothschild | G07F 17/32 463/42 |
| 2006/0025210 | A1 | 2/2006 | Johnson | |
| 2006/0258436 | A1* | 11/2006 | McBride | G07F 17/32 463/20 |
| 2006/0287098 | A1* | 12/2006 | Morrow | G07F 17/32 463/42 |
| 2008/0108423 | A1 | 5/2008 | Benbrahim | |
| 2009/0239660 | A1 | 9/2009 | Acres | |
| 2009/0275399 | A1 | 11/2009 | Kelly et al. | |
| 2009/0305776 | A1 | 12/2009 | Englman et al. | |
| 2010/0048293 | A1 | 2/2010 | Hornik | |
| 2010/0304832 | A1 | 12/2010 | Kup-Ferroth | |

(Continued)

FOREIGN PATENT DOCUMENTS

| | | |
|---|---|---|
| WO | 2006015335 | 2/2006 |

OTHER PUBLICATIONS

USPTO; Final Office Action dated Jun. 26, 2017 in U.S. Appl. No. 15/362,469.

(Continued)

*Primary Examiner* — Omkar A Deodhar
(74) *Attorney, Agent, or Firm* — Snell & Wilmer L.L.P.

(57) ABSTRACT

A gaming system may comprise a processor, a gaming machine in electronic communication with the processor, and a memory device in electronic communication with the processor with a first game and a second game stored thereon. The first game may have a first return percentage and the second game may have a second return percentage, wherein the first return percentage and the second return percentage are different. A player may elect to play the first game or the second game by selecting a first game selection device or a second game selection device, respectively, with a goal of figuring out which game has the higher return percentage.

15 Claims, 6 Drawing Sheets

202 210 220

| *Payout for bet 1* | *First Game probabilities* | *Second Game probabilities* |
|---|---|---|
| *2* | 0.05 | 0.05 |
| *5* | 0.07 | 0.06 |
| *10* | 0.02 | 0.02 |
| *20* | 0.005 | 0.005 |
| *50* | 0.002 | 0.002 |
| *100* | 0.0003 | 0.0003 |
| *200* | 0.0002 | 0.0002 |
| *500* | 0.00006 | 0.00006 |
| *Total return percentage* | 95.00% | 90.00% |
| *Hit frequency* | 14.76% | 13.76% |

205

(56) References Cited

U.S. PATENT DOCUMENTS

| | | | | |
|---|---|---|---|---|
| 2011/0021268 | A1 | 1/2011 | Bramble | |
| 2012/0208626 | A1* | 8/2012 | Hein ..... | A61B 17/07207 463/25 |
| 2013/0225277 | A1 | 8/2013 | Hughes | |
| 2014/0162762 | A1 | 6/2014 | Aoki et al. | |
| 2016/0027257 | A1 | 1/2016 | Yoseloff et al. | |
| 2016/0042609 | A1 | 2/2016 | Kitamura | |
| 2017/0053486 | A1 | 2/2017 | Talkeda | |
| 2017/0169657 | A1 | 6/2017 | Keilwert | |

OTHER PUBLICATIONS

USPTO; Notice of Allowance dated Aug. 14, 2017 in U.S. Appl. No. 15/362,469.

EPO; European Search Report dated Dec. 12, 2017 in Application No. 17198384.4.

USPTO; Office Action dated Feb. 21, 2017 in U.S. Appl. No. 15/362,469.

USPTO; Non-Final Office Action dated Apr. 13, 2018 in U.S. Appl. No. 15/785,328.

PCT; International Search Report and Written Opinion dated Apr. 9, 2018 in Application No. PCT/ IB2018/000053.

* cited by examiner 202 210 220

| *Payout for bet 1* | *First Game probabilities* | *Second Game probabilities* |
|---|---|---|
| *2* | 0.05 | 0.05 |
| *5* | **0.07** | **0.06** |
| *10* | 0.02 | 0.02 |
| *20* | 0.005 | 0.005 |
| *50* | 0.002 | 0.002 |
| *100* | 0.0003 | 0.0003 |
| *200* | 0.0002 | 0.0002 |
| *500* | 0.00006 | 0.00006 |
| *Total return percentage* | 95.00% | 90.00% |
| *Hit frequency* | 14.76% | 13.76% |

205

FIG. 2

GAMING SYSTEMS AND METHODS FOR OFFERING A PLAYER MULTIPLE GAMES

FIELD

The present invention relates generally to gaming machines and systems, and more particularly, to gaming machines and systems found in casinos or betting environments.

BACKGROUND

Gaming machines, otherwise known as slot machines, poker machines, video lottery terminals, or gaming consoles, have proven very popular within the gaming environment to become one of the base elements of the gaming industry. Players, however, quickly become tired of various adaptations of gaming machines, demanding new and inventive ways to represent or play games on such gaming machines. For this reason, game creators must continually invent new and innovative ways to represent games, game play, and award types to stimulate players to encourage further interest.

SUMMARY

In accordance with various aspects, a gaming system and method are configured to provide various options for a player to play one or more of multiple games. Of the multiple games offered to the player, at least two of the games may have different return percentages. Therefore, a player may attempt to determine which game(s) of the offered games provide the best odds for the player.

In various embodiments, a gaming system may comprise a processor, a gaming machine in electronic communication with the processor comprising a first game selection device and a second game selection device, and a memory device in electronic communication with the processor. Multiple games may be stored on the memory device (e.g., a first game and a second game). The gaming machine may provide a first option for a player to select the first game selection device to play the first game and a second option for the player to select the second game selection device to play the second game. The first game may comprise a first return percentage, and the second game may comprise a second return percentage different than the first return percentage. Therefore, a player may play the first and second games on the gaming machine numerous times to try to observe which of the games has the higher return percentage, and therefore, provides better odds for the player to win.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. In the figures, like referenced numerals may refer to like parts throughout the different figures unless otherwise specified.

FIG. 2 depicts payout tables associated with games of a gaming system, in accordance with various embodiments.

DETAILED DESCRIPTION

Figure 1A:
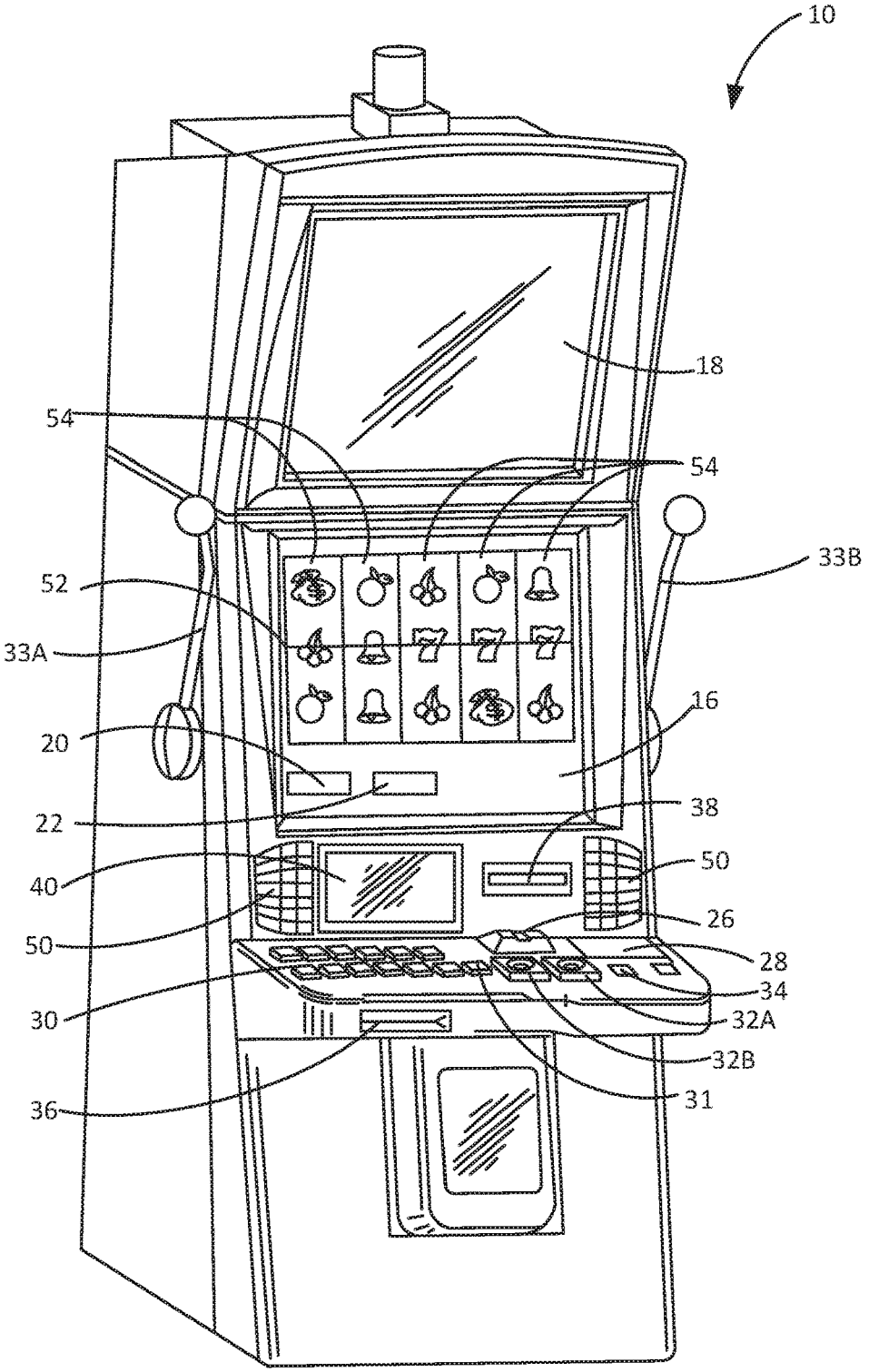
FIG. 1A depicts a perspective view of a gaming machine, in accordance with various embodiments.

The detailed description of various embodiments herein makes reference to the accompanying drawings, which show the exemplary embodiments by way of illustration. While these exemplary embodiments are described in sufficient detail to enable those skilled in the art to practice the disclosure, it should be understood that other embodiments may be realized and that logical, compositional, and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component or step may include a singular component or step. Also, any reference to attached, fixed, connected or the like may include permanent, removable, temporary, partial, full and/or any other possible attachment option.

Several (or different) elements discussed below, and/or claimed, are described as being "coupled", "in communication with", or "configured to be in communication with". This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis.

The methodologies described herein may be implemented by various means depending upon applications according to particular examples. For example, such methodologies may be implemented in hardware, firmware, software, or combinations thereof. In a hardware implementation, for example, the controller or processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Unless specifically stated otherwise, as apparent from the discussion herein, it is appreciated that throughout this specification discussions utilizing terms such as "processing," "computing," "calculating," "determining" or the like refer to actions or processes of a processor, such as a processor on a special purpose computer or a similar special purpose electronic computing device. In the context of this description, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

For clarity in discussing the various functions of the system, multiple computers and/or servers are discussed as performing different functions. These different computers (or servers) may, however, be implemented in multiple different ways such as modules within a single computer, as nodes of a computer system, etc. The functions performed by the system (or nodes or modules) may be centralized or distributed in any suitable manner across the system and its components, regardless of the location of specific hardware. Furthermore, specific components of the system may be referenced using functional terminology in their names. The function terminology is used solely for purposes of naming convention and to distinguish one element from another in the following discussion. Unless otherwise specified, the name of an element conveys no specific functionality to the element or component. It should be appreciated that, in various embodiments, the software, hardware, and associated components of the system may be programmed and configured to implement one or more embodiments described herein. It should also be appreciated that the various aspects of the system may be exemplified as software, modules, nodes, etc., of a computer or server.

The gaming systems and methods described herein may be implemented in various configurations for gaming machines, gaming devices, or gaming systems, including but not limited to: (1) a dedicated gaming machine, gaming device, or gaming system wherein the computerized instructions for controlling any games (which may be provided by the gaming machine or gaming device) are provided with the gaming machine or gaming device prior to delivery to a gaming establishment; and (2) a changeable gaming machine, gaming device, or gaming system wherein the computerized instructions for controlling any games (which may be provided by the gaming machine or gaming device) are downloadable to the gaming machine or gaming device through a data network after the gaming machine or gaming device is in a gaming establishment. In various embodiments, the computerized instructions for controlling any games are executed by at least one central server, central controller, or remote host. In such "thin client" embodiments, the central server remotely controls any games (or other suitable interfaces) and the gaming system is utilized to display such games (or suitable interfaces) and/or receive one or more inputs or commands from a player. In various embodiments, the computerized instructions for controlling any games are communicated from the central server, central controller, or remote host to a gaming device local processor and memory devices. In such "thick client" embodiments, the gaming device local processor executes the communicated computerized instructions to control any games (or other suitable interfaces) provided to a player.

In accordance with various embodiments, the gaming systems and methods described herein are configured to offer multiple games to a player. In various embodiments, at least two of the games offered may have different return percentages. Therefore, a player may play more than one of the games multiple times and attempt to determine which game(s) of the offered games provide the best odds for the player.

The gaming systems and methods discussed herein, in various embodiments, may be implemented on a gaming machine. For example, referring to FIG. 1A, in various embodiments, a gaming machine 10 may have a support structure, housing, or cabinet which provides support for a plurality of displays, inputs, controls, and other features of a conventional gaming machine. Gaming machine 10 may be positioned on a base or stand or can be configured as a pub-style table-top game (not shown) which a player can operate preferably while sitting. It should be appreciated that gaming machine 10 may have varying cabinet and display configurations.

Figure 1B:
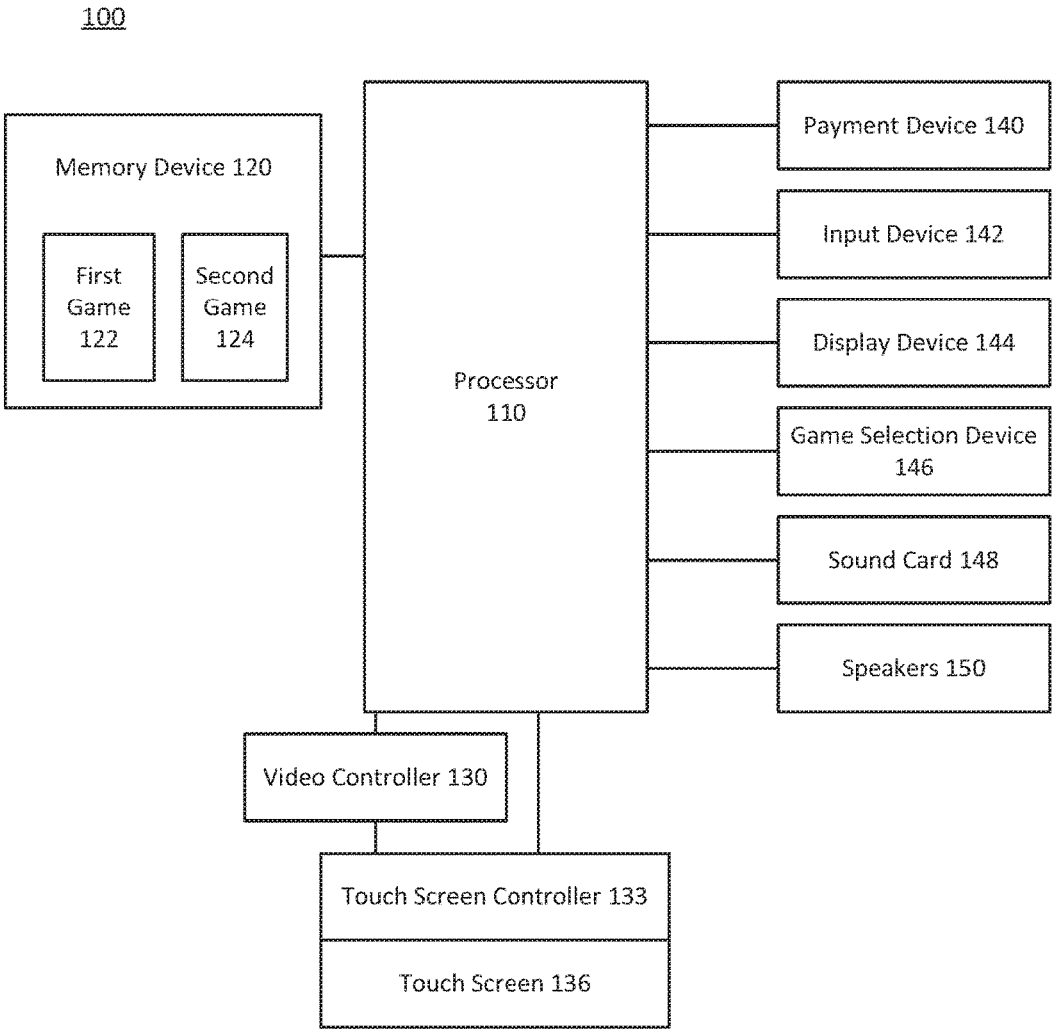
FIG. 1B depicts a block diagram of a gaming system, in accordance with various embodiments.

In various embodiments, with combined reference to FIGS. 1A and 1B, gaming system 100, which may comprise and/or be implemented through gaming machine 10, may include one or more display devices 144 controlled by processor 110, such as a central display device 16, an upper display device 18, and/or a player tracking display 40 on gaming machine 10. Display devices 144 may be preferably connected to or mounted on the cabinet of gaming machine 10. In various embodiments, gaming machine 10 may include central display device 16 which may display one or more games as well as information relating to the game(s). In various embodiments, gaming machine 10 may comprise upper display device 18. Upper display device 18 may display one or more games as well as information relating to the game(s). These display devices may also serve as digital glass operable to advertise games or other aspects of the gaming establishment. In various embodiments, gaming machine 10 may comprise a credit display 20 which displays a player's current number of credits, cash, account balance, or the equivalent. In various embodiments, gaming machine 10 may include a bet display 22 which displays a player's amount wagered. In various embodiments, gaming machine 10 may include player tracking display 40 which displays information regarding a player's play tracking status. It should be appreciated that these devices are in communication with processor 110.

In various embodiments, at least one display device may be a mobile display device, such as a PDA or tablet PC, that enables play of at least a portion of a game at a location remote from gaming machine 10 and/or gaming system 100.

Display devices 16, 18, 40 may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In various embodiments, as described in more detail below, the display device includes a touch-screen with an associated touch-screen controller. The display devices may be of any suitable size and configuration, such as a square, rectangle, elongated rectangle, oval, etc.

Display devices 16, 18, 40 of gaming machine 10 are configured to display at least one game and associated images, symbols, and indicia such as any visual representation or exhibition of the movement of objects such as mechanical, virtual, or video reels and wheels, etc., and the like. In various embodiments, central display device 16, upper display device 18, and/or player tracking display 40 may be divided into one or more screens or sub-display devices, to display one or more games, symbols, graphics, or other images/information.

In various embodiments, the symbols, images and indicia displayed on or of display device(s) 16, 18, 40 may be in mechanical form. That is, the display device may include any electromechanical device, such as one or more mechanical objects, such as one or more rotatable wheels or reels 54 configured to display at least one or a plurality of games or other suitable images, symbols or indicia.

As illustrated in FIG. 1B, in various embodiments, gaming system 100 may include at least one payment device 140 in communication with processor 110. Payment device 140 may accept a physical item associated with a monetary value and may establish or increase a credit balance for the player based on the monetary value. With further reference to FIG. 1A, the payment device 140 may be a payment acceptor 28 including a note, ticket, card, and/or bill acceptor 28 wherein the player inserts paper money, a ticket, or voucher, and/or a coin slot 26 where the player inserts money, coins, or tokens. In various embodiments, payment devices 140 such as readers or validators for credit cards, debit cards, and/or credit slips may accept payment.

In various embodiments, a player may insert an identification card into a card reader of gaming machine 10. In various embodiments, the identification card is a smart card having a programmed microchip, a coded magnetic strip, or coded rewritable magnetic strip, wherein the programmed microchip or magnetic strips are coded with a player's identification, credit totals (or related data), and/or other relevant information. In various embodiments, a player may carry a portable device, such as a cell phone, a radio frequency identification tag, or any other suitable wireless device, which communicates a player's identification, credit totals (or related data), and other relevant information to gaming machine 10. In various embodiments, money may be transferred to a gaming machine 10 through electronic funds transfer. It should be appreciated that, when a player funds gaming machine 10, processor 110 determines the amount of funds entered and displays the corresponding amount on the credit or other suitable display as described previously.

With continued reference to FIGS. 1A and 1B, in various embodiments, gaming machine 10 and gaming system 100 may include at least one an input device 142 in communication with processor 110. Input device(s) 142 may include any suitable device which enables the player to produce an input signal which is received by processor 110.

In various embodiments, an input device 142 may be a wager input device, such as a wager button 31. The player may place a bet by pushing wager button 31. Wager button 31 may be a bet one button, which by selecting, the player may wager one credit (i.e., a number of credit points, dollars, cents, etc.). The player may increase the bet by one credit each time the player pushes the bet one button. In response to the player pushing the bet one button, the number of credits shown in the credit display may decrease by one, and the number of credits shown in the bet display may increase by one. In various embodiments, an input device 142, such as wager button 31, may be a bet max button, which may enable the player to bet the maximum wager. In various embodiments, an input device 142 may be one or more intermediate wager buttons 30, which may allow a player to bet one or more intermediate wagers that are permitted or accepted for a game of gaming machine 10.

In various embodiments, input device 142 may be a cash-out button 34. The player may push cash-out button 34 and initiate a "cash-out" operation to receive a cash payment or other suitable form of payment corresponding to the number of remaining credits. In various embodiments, in response to the player cashing out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In various embodiments, in response to the player cashing out, the player may receive the coins or tokens in a coin payout tray.

In various embodiments, gaming machine 10 includes at least one card reader 38 in communication with processor 110. In this embodiment, a player is issued a player identification card which has an encoded player identification number that uniquely identifies the player. In response to a player inserting their player tracking card into the card reader to begin a gaming session, the card reader reads the player identification number off the player tracking card to identify the player. It should be appreciated that any suitable payout mechanism, such as funding to the player's electronically recordable identification card or smart card, may be implemented in accordance with gaming machine 10.

In various embodiments, an input device 142 may be a touch-screen 136 coupled with a touch-screen controller 133 or some other touch-sensitive display overlay to allow for player interaction with the images on a display device 144 (e.g., central display device 16, upper display device 18, and/or player tracking display 40). Touch-screen 136 and/or touch-screen controller 133 may be coupled to a video controller 130. A player may make decisions and input signals into gaming machine 10 or gaming system 100 by touching touch-screen 136 at the appropriate locations. One such input device 142 is a conventional touch-screen button panel.

Gaming system 100 may further include a plurality of communication ports for enabling communication of the processor with external peripherals, such as external video sources, expansion buses, game or other displays, a SCSI port, or a keypad.

In various embodiments, with continued reference to FIGS. 1A and 1B, gaming system 100 may include a sound generating device controlled by one or more sounds cards 148 which function in conjunction with processor 110. In various embodiments, the sound generating device may include at least one speaker 150 (e.g., speakers 50 of gaming machine 10) or other hardware and/or software for generating sounds, such as by playing music for a game(s), or by playing music for other modes of gaming machine 10, such as an attract mode. In various embodiments, gaming machine 10 may provide dynamic sounds coupled with attractive multimedia images displayed on one or more of the display devices 144 to provide an audio-visual representation or to otherwise display full-motion video with sound to attract players to gaming machine 10. During idle periods, gaming machine 10 may display a sequence of audio and/or visual attraction messages to attract potential players to gaming machine 10. The videos may also be customized to provide any appropriate information.

Gaming machine 10 may incorporate any suitable wagering game(s). Gaming machine 10 may include some or all of the features of conventional gaming machines or devices (e.g., slot machines). In various embodiments, a game(s) on gaming machine 10 may be any suitable reel-type game susceptible to representation in an electronic or electromechanical form, which may produce a random outcome based on payout probability data at the time of or after placement of a wager. Alternatively, game(s) may be a video poker game, a video bingo or keno game, a Class II game displayed using Class III visual elements (e.g., a video slot game that uses a bingo-based ball call), or any other suitable game.

In various embodiments, as illustrated in FIG. 1A, a game played on gaming machine 10 may be a slot game with one or more pay lines 52. Pay lines may be horizontal, vertical, circular, diagonal, angled or any combination thereof. In various embodiments, the gaming device includes at least one reel 54, for example, three to five reels 54, in either electromechanical form with mechanical rotating reels or video form with simulated reels and movement thereof. In various embodiments, an electromechanical slot machine includes a plurality of adjacent, rotatable reels which may be combined and operably coupled with an electronic display of any suitable type. In various embodiments, if reels 54 are in video form, one or more of display devices 144, as described above, may display the plurality of simulated video reels 54. Each reel 54 may comprise and display a plurality of indicia or symbols, such as bells, hearts, fruits, numbers, letters, bars, or other images which preferably correspond to a theme associated with the gaming device. In various embodiments, one or more of reels 54 are independent reels or unisymbol reels. In such embodiments, each independent or unisymbol reel generates and displays one symbol to the player. In various embodiments, gaming machine 10 may award prizes after reels 54 of the game(s) stop spinning if specified types and/or configurations of indicia or symbols occur on an active payline or otherwise occur in a winning pattern, occur on the requisite number of adjacent reels, and/or occur in a scatter pay arrangement.

In various embodiments, in addition to winning credits or other awards in a game on gaming machine 10, the gaming device may also give players the opportunity to win credits in a bonus or secondary round of a game. The bonus or secondary round enables the player to obtain a prize or payout in addition to the prize or payout, if any, obtained from the base or primary round of the game. In general, a bonus or secondary round produces a significantly higher level of player excitement than the base or primary round of the game because it provides a greater expectation of winning than the base or primary round, and is accompanied with more attractive or unusual features than the base or primary round. It should be appreciated that, in one embodiment, the bonus or secondary round is similar to the base or primary round.

In various embodiments, input device 142 may be a game activation device (e.g., a play button), which is used by the player to start the selected game or sequence of events in the gaming machine 10. The play button can be any suitable play activator such as a bet one button, a max bet button, or a repeat the bet button. In various embodiments, upon appropriate funding, gaming machine 10 begins the game play of a selected game automatically. In various embodiments, upon the player engaging one of the play buttons, gaming machine 10 automatically activates game play.

In various embodiments, gaming machine 10 may comprise one or more game selection devices 146, such one or more game selection buttons 32A and/or 32B and/or one or more pull arms 33A and/or 33B, which may be used by the player to select and/or start a game or sequence of events on gaming machine 10. Therefore, gaming system 100 and/or gaming machine 10 may provide options for a player to play different games (e.g., a first option to play first game 122 and a second option to play a second game 124). In various embodiments, multiple games may be displayed on one screen, such as central display device 16 or upper display device 18, either one at a time, or side-by-side, or first game 122 and second game 124 may be the same game type having the same graphics, but differ in other ways, as described herein. In various embodiments, each game offered to the player by gaming system 100 and/or gaming machine may have a separate screen for display.

Gaming system 100 for playing the casino game, as depicted in FIG. 1B, according to various embodiments, may be a separate gaming system or may comprise gaming machine 10 of FIG. 1A. With reference to FIG. 1B, gaming system 100 may comprise at least one processor 110, such as a microprocessor, a microcontroller-based platform, a suitable integrated circuit or one or more application-specific integrated circuits (ASIC's). Processor 110 may be in communication with, or operable to access or to exchange signals, with at least one data storage or memory device 120.

In various embodiments, with combined reference to FIGS. 1A and 1B, processor 110 and/or memory device 120 may reside within the cabinet of gaming machine 10. Memory device 120 may store program code and/or instructions, executable by processor 110, to control gaming machine 10. Memory device 120 may also store other data such as image data, event data, player input data, random or pseudo-random number generators, pay-table data or information, and applicable game rules that relate to the play of the casino game. In various embodiments, memory device 110 may comprise the information, instructions, data, etc. for at least two games, such as first game 122 and a second game 124. First game 122 and second games 124 may be games that a player may play on gaming machine 10. First game 122 and second games 124 may be different game types, or the same game type having different aspects (e.g., different graphics, wager options, return percentages, and/or the like). Gaming system 100 may be computer-based, and memory device 120 may be a tangible non-transitory computer-readable memory. Instructions stored on the tangible non-transitory memory may allow system 100 to perform various functions, as described herein.

In various embodiments, with continued reference to FIGS. 1A and 1B, gaming system 100 may be configured such that at least two games may be played on a single gaming machine 10, such as first game 122 and second game 124 stored in memory device 120. In various embodiments, memory device 120 may store more than two games, i.e., a third game, a fourth game, or any number of desired games. However, for simplicity, gaming system 100 and gaming machine 10 will be described herein having first game 122 and second game 124.

In various embodiments, as described above, different games offered by gaming system 100 and/or gaming machine 10 (e.g., first game 122 and second game 124) may differ in one or more ways. In various embodiments, with the example of first game 122 and second game 124 being offered by gaming system 100 and/or gaming machine 10, first game 122 and second game 124 may be completely different game types, having different themes (e.g., a jungle theme versus a pirate theme) and features, for example, different reels 54 (having different symbols, numbers of symbols, winning combinations, etc.), different numbers of reels 54, different pay lines 52 or number of pay lines 52, different wager options, etc. In various embodiments, first game 122 and second game 124 may be different versions of the same game type (i.e., having the same theme), in that some of the features of the games may be different between first game 122 and second game 124. For example, first game 122 and second game 124 may have the same theme, symbols, graphics, etc., but may have different numbers of reels 54, different number of symbols on reels, different wager options, different pay lines, etc. In various embodiments, first game 122 and second game 124 may be identical, except for having different return percentages, as described herein, which may also be referred to as different versions of the same game type. For example, first game 122 and second game 124 may utilize the same reels 54, symbols, and pay lines 52, but one of the games has better odds for the player via a higher return percentage.

In various embodiments, first game 122 and second game 124, regardless of how they differ (whether different game types or versions of the same game type), may have different return percentages associated with them. A return percentage is the average percentage of all wagered money in a game on a gaming machine 10 (or on a collection of gaming machines 10) that is paid back to players over time. For example, a game with a return percentage of 0.95 may be understood to mean that on average, if a player were to place a $1 bet 100 times, for a total of $100 wagered, the player may expect to receive $95 in payouts. In various embodiments, first game 122 may have a first return percentage, and second game 124 may have a second return percentage. The first return percentage may be different than the second return percentage (i.e., one of the first return percentage or the second return percentage may be higher, and therefore, more favorable to a player). A player may or may not know the return percentages of the games available to him or her on gaming system 100.

The return percentages between games offered to a player on gaming system 10 and/or gaming machine 10 may vary in any suitable manner. For example, with combined reference to FIGS. 1A, 1B, and 2, a first pay table 210 may be associated with first game 122, and a second pay table 220 may be associated with second game 124. Pay tables 210 and 200 may indicate the probabilities that a player may receive certain payout amounts (listed in payout column 202) for a bet of 1 credit. As depicted in FIG. 2, first pay table 210 and second pay table 220 have exactly the same probabilities for all payout amounts, listed in payout column 202, except for a payout of five, listed in payout row 205. Payout row 205 indicates that the probability of receiving a payout of 5 from first game 122 (listed in first pay table 210) is about 0.07, while the probability of receiving a payout of 5 from second game 124 (listed in first pay table 220) is about 0.06. Therefore, in this example, first game 122 has a return percentage of 95% and second game 124 has a return percentage of 90%, the difference being caused by the probabilities difference between first game 122 and second game 124 in payout row 205.

In various embodiments, the return percentages between games may differ in any suitable manner. For example, multiple payout amounts in a payout column 202 may have different probabilities between first game 122 and second game 124, or first game 122 and second game 124 may have completely different pay tables, such that the payout amounts listed in payout column 202, and/or the payout probabilities (e.g., those listed in first pay table 210 and second pay table 220), may be different between the games.

In various embodiments, the player may be aware that his or her game options, such as first game 122 and second game 124, have different return percentages, but may not be aware of which game has better odds for the player. Therefore, it may be the player's goal to figure out, by playing first game 122 and second game 124 multiple times, which game available to him or her on gaming machine 10 has the best odds to receive return of the wagers made. If the player thinks he or she has figured out which game provides the better return percentage, the player may play that game exclusively, or more frequently than the other game, in hopes of receiving the best return for his or her wager.

In various embodiments, with further reference to FIGS. 1A and 1B, gaming system 100 and/or gaming machine 10 may offer first game 122 and second game 124 to a player. That is each wager, or set of wagers, by a player may be utilized to play either first game 122 or second game 124. In operation, in various embodiments, a player of gaming machine 10 may select a wager amount by selecting wager button 31, or an intermediate wager button 30, and select which of first game 122 and second game 124 to play. The player may select which game to play by selecting a game selection device 146. Game selection device(s) may be anything which a player may select to indicate which offered game the player wishes to play (i.e., there may be a game selection device associated with each game offered to the player). For example, game selection device(s) 146 may be game selection button 32A or 32B. Game selection button 32A may be associated with first game 122, and game selection button 32B may be associated with second game 124. In such an example, the player may elect to play first game 122 by selecting game selection button 32A, or elect to play second game 124 by selecting game selection button 32B. In various embodiments, the player may select which game to play before placing a wager. In various embodiments, the game selection devices 146 may be provided by touch screen 136, wherein touch screen 136 may provide digital game selection buttons (similar to game selection buttons 32A and 32B) to select the desired game. Therefore, when discussing game selection buttons 32A and 32B herein, a person skilled in the art would understand that game selection buttons 32A and 32B may be digitally implemented on a touch screen 136. In various embodiments, a selector device may enable toggling between the game selection devices, such as a computer mouse or a roller ball, which may select the game selection device associated with the desired game.

In various embodiments, game selection buttons 32A and 32B, in addition to acting as game selection devices 146, may act as game activation devices (e.g., play buttons) to activate their respective games in response to being selected. For example, in response to game selection button 32A being selected, first game 122 may activate and play a round to utilize the player's wager. Likewise, in response to game selection button 32B being selected, second game 124 may activate and play a round to utilize the player's wager. In various embodiments, to activate the game selected, a separate game activation device (e.g., a button) may be selected, which may be a distinct device on gaming machine 10, and/or a wager button (e.g. wager button 31 or intermediate wager buttons 31) may activate a selected game, in response to a game of first game 122 and second game 124 already being selected. In various embodiments, a game selection may remain while a player is playing on gaming machine 10 until the player changes the game selection. For example, if a player wishes to play first game 122, the player may select game selection button 32A which may activate first game 122, assuming a wager was placed. In embodiments in which game selection button 32A may not activate first game 122, the player may select a game activation device to activate first game 122. In this example, the player may activate first game 122 without having to reselect game selection button 32A for every play. However, if the player wanted to subsequently play second game 124, the player would select game selection button 32B and activate second game 124.

In various embodiments, with continued reference to FIGS. 1A and 1B, game selection device 146 may be a pull arm, such as pull arms 33A and 33B. For example, pull arm 33A may be associated with first game 122, and pull arm 33B may be associated with second game 124. In such an example, the player may place a wager and elect to play first game 122 by pulling pull arm 33A, or elect to play second game 124 by pulling pull arm 33B. Pull arms 33A and 33B may serve as game selection devices and game activation devices. In various embodiments, pull arm 33A and/or 33B may serve as game activation device, rather than a game selection device 146. For example, a player may select first game 122 or second game 124 to play by selecting game selection button 32A or 32B, respectively, and to activate the selected game, the player may then pull arm 33A and/or 33B. In various embodiments, game selection device 146 may be at least one foot pedal or other physical lever or button on gaming machine 10 for selecting a game.

In various embodiments, while a player is playing a gaming system 100 and/or gaming machine 10, the return percentages may remain the same for their respective games during the player's gaming session. As an example, while a player is playing during a gaming session, the return percentage of first game 122 and second game 124 may remain fixed. That way, a player may play the games offered on gaming machine to try to figure out which game has the higher return percentage.

A gaming session may be the duration that a player is playing on a gaming system 100 and/or gaming machine 10. A gaming session may begin in response to money, credit, or other payment being applied to gaming machine 10 to fund wagers (after a previous player has cashed out, or gaming machine 10 was idle for a certain amount of time), a player identification card being inserted into or otherwise presented to gaming system 100 and/or gaming machine 10, and/or any other indicator that a new player is utilizing gaming machine 10. A gaming session may end in response to a player cashing out, gaming machine 10 being idle for a certain period of time, or any other indicator that a player has finished playing at gaming machine 10.

The return percentages for the games (e.g., first game 122 and second game 124) may be changed or reset in response to a percentage reset event. In various embodiments, a percentage reset event may occur at the beginning or end of a gaming session. In various embodiments, a percentage reset event may occur in response to a certain amount of time having lapsed on gaming machine 10 without activity (e.g., 60 seconds), in response to a certain amount of time having lapsed during a gaming session, or in response to a randomly varying amount of time having lapsed during a gaming session. In various embodiments, a percentage reset event may occur in response to the player receiving a reset payout amount during a gaming session (e.g., a jackpot, or any amount set in gaming system 100 and/or gaming machine 10 to qualify as a percentage reset event). In various embodiments, gaming system 100 may be configured to change the return percentages of the games (e.g., first game 122 and second game 124) in response to each play (e.g., each spin of reels 54), each number to desired plays, or a randomly varying number of plays. In various embodiments, gaming system 100 may be configured to change the return percentages of the games in response to a player switching use between play selection devices (e.g., using pull arms and then using game selection buttons), and/or switching between games (e.g., in response to a player playing first game 122 for a required amount of time, and then switching to second game 124). By changing the return percentages of the multiple games offered on gaming system 100 and/or gaming machine 10, a player must start over in observing the payouts for the games in order to try to predict which game has the higher return percentage. Also, a player may be aware of which events on gaming system 100 will cause a return percentage reset, and may take such an action in order to cause the return percentage reset.

The return percentages of the games (e.g., first game 122 and second game 124) may be selected, determined, and/or assigned to the games at any time in any suitable manner. In various embodiments, the return percentages of first game 122 and second game 124 may be fixed, such that the return percentages for first game 122 and second game 124 may remain the same between gaming sessions. In such embodiments, the game associated with game selection devices 146 (e.g., game selection devices 32A and 32B and/or pull arms 33A and 33B) may be randomly switched or determined in response to a percentage reset event, such that a player will not know which of first game 122 or second game 124 is associated with which game selection device 146. Similarly, in various embodiments, a gaming system 100 and/or gaming machine 10 may have two return percentages, and first game 122 may be randomly assigned one of the return percentages, and second game 124 may be assigned the other, in response to a percentage reset event.

In various embodiments, one of first game 122 or second game 124 may have a fixed return percentage, such that the return percentage for that game never changes. In such embodiments, the return percentage for the other game may be randomly changed in response to the occurrence of a percentage reset event. In various embodiments, first game 122 and/or second game 124 may be assigned a random return percentage in response to a percentage reset event. In various embodiments, gaming system 100 and/or gaming machine 10 may have multiple return percentages, from which the games each may be assigned a return percentage randomly or systematically. With additional reference to FIG. 2, the return percentages may be randomly generated or determined by processor 110 randomly varying the values in a payout column (e.g., payout column 202) and/or the payout probabilities. Random number generation may be realized by various methodologies, for example, the random number generator techniques and systems set forth in U.S. Pat. No. 9,336,646, or any other random number generator techniques or systems now known or hereinafter devised.

In various embodiments, the games (or return percentages associated with the games) offered to a player by gaming system 100 and/or gaming machine 10 may be selected from several games (or return percentages) stored in memory device 120. For example, gaming system 100 may have ten games (or any suitable number of games) stored in memory device 120, wherein at least two of the stored games have different return percentages. At the beginning of a gaming session, for example, two games (or any number of games that will be presented to the player to choose between) of the ten stored games may be randomly selected by gaming system 100 to present to the player. At least two of the randomly selected games presented to the player will have different return percentages such that the player will play the presented games to try to figure out which game(s) have the higher return percentages. In various embodiments, the games stored in memory device 120 may all be entirely different game types, and/or some of the games may be different versions of the same game type (e.g., differing only in return percentages).

Continuing with the example above, five of the ten stored games may be different versions of one game type (e.g., a game with a jungle theme), with at least two of the versions having different return percentages, and the other five of the ten stored games may be different versions of a second game type (e.g., a game with a pirate theme). In various embodiments, in selecting the games to present to a player, gaming system 10 and/or gaming machine 10 may select at least two games from any of the ten stored games, or one game from each game type (e.g., in the above example with two game types, gaming system 10 and/or gaming machine 10 may select one jungle-themed game and one pirate-themed game), such that at least two of the games presented to the player have different return percentages. In various embodiments, memory device 120 may store multiple return percentages, from which the necessary number of return percentages (equal to the number of games presented to the player) may be selected and assigned to the games presented to the player at the beginning of a gaming session or in response to a percentage reset event.

In various embodiments, gaming system 100 and/or gaming machine 10 may provide more than two games to the player. In such embodiments, gaming system 100 and/or gaming machine 10 may determine and/or assign a return percentage for each game by any of the methods described herein. In various embodiments, at least two of the games have different return percentages, such that a player may play the games to observe payout amounts/frequencies for each game, with the goal of determining which game would be the preferred game to play (the game with the highest return percentage). For example, gaming system 100 and/or gaming machine 10 may comprise a third game, in addition to first game 122 and second game 124, which may be assigned a third return percentage. The third return percentage may be different than the first and/or second return percentage associated with first game 122 and second game 124, respectively. Gaming system 100 and/or gaming machine 10 may provide a game selection device 146 (and/or game activation device) for the third game, such as a third game selection button similar to 32A/33B, or an additional pull arm on gaming machine 10.

In various embodiments, processor 110 may randomly generate payout tables, payout probabilities, return percentages, and/or the like. In various embodiments, this random determination may be provided through utilization of a random number generator (RNG), such as a true random number generator, a pseudo random number generator, or other suitable randomization process. In various embodiments, each award or other game outcome is associated with a probability and the gaming device generates the award or other game outcome to be provided to the player based on the associated probabilities. In various embodiments, since the gaming device generates outcomes randomly or based upon one or more probability calculations, there is no certainty that the gaming device will ever provide the player with any specific award or other game outcome.

In various embodiments, the memory device 120 may include random access memory (RAM), which may include non-volatile RAM (NVRAM), magnetic RAM (MRAM), ferroelectric RAM (FeRAM), and other forms as commonly understood in the gaming industry. In various embodiments, memory device 120 may include read only memory (ROM). In various embodiments, memory device 120 includes flash memory and/or EEPROM (electrically erasable programmable read only memory). It should be appreciated that, any other suitable magnetic, optical, and/or semiconductor memory may operate in conjunction with the gaming system 100.

In various embodiments, part or all of the program code and/or operating data described above can be stored in a detachable or removable memory device 120, including, but not limited to, a suitable cartridge, disk, CD ROM, DVD, or USB memory device. In various embodiments, part or all of the program code and/or operating data described above can be downloaded to memory device 120 through a suitable network.

In various embodiments, an operator or a player can use such a removable memory device in a desktop computer, a laptop computer, a hand-held device, such as a personal digital assistant (PDA), a portable computing or mobile device, or another computerized platform to implement the present invention. In various embodiments, gaming system 100 is operable over a wireless network, for example as part of a wireless gaming system. In various embodiments, gaming system 100 and/or gaming machine 10 may be a hand-held device, a mobile device, or any other suitable wireless device that enables a player to play any suitable game at a variety of different locations. In various embodiments in which gaming system 100 is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that processor 110 and memory device 120 may be collectively referred to herein as a "computer" or "controller."

Figure 3:
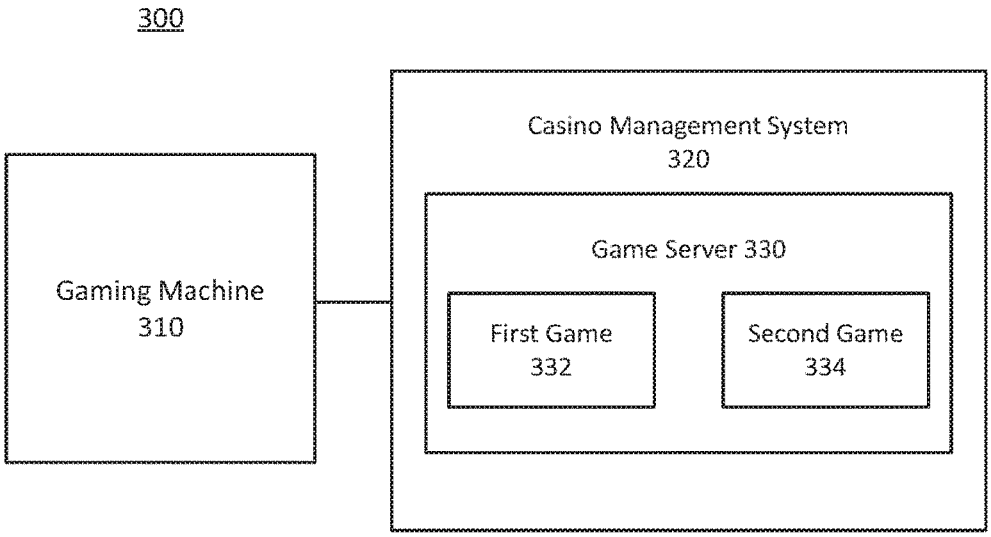
FIG. 3 depicts a block diagram of a gaming server system, in accordance with various embodiments.

In various embodiments, with reference to FIG. 3, a gaming server system 300 includes a casino management system 320 which may be coupled a gaming machine(s) 310 (for example, gaming machine 10 in FIG. 1). Casino management system 320 may comprise a game server 330, which may be in communication with gaming machine 310. In various embodiments, game server 330 may include at least one processor and at least one memory or storage device. In various embodiments, game server 330 may be implemented as a progressive controller or a processor of one of gaming machines 310 in gaming server system 330.

In various embodiments described herein, the processor of each gaming machine 310 may be designed to transmit and receive events, messages, commands, or any other suitable data or signal between the individual gaming machine(s) 310 and casino management system 320 (e.g., game server 330). The gaming machine processor is operable to execute such communicated events, messages, or commands in conjunction with the operation of gaming machine 310. Moreover, the processor(s) of the game server 330 may be designed to transmit and receive events, messages, commands, or any other suitable data or signal between the central server and each of the individual gaming machines 310.

In various embodiments, the data network is the Internet. The operation of gaming machine 10 may be viewed with an internet browser operating on a user device or another suitable computer. In various embodiments, operation of gaming machine 10 and accumulation of credits may be accomplished with only a connection to the casino management system 320 through a conventional phone or other data transmission line, cell phone tower, digital subscriber line (DSL), T-1 line, coaxial cable, fiber optic cable, or other suitable connection. Players may access an internet game page from any location where an internet connection and computer or other internet facilitator is available.

In various embodiments, the present invention may be employed in a server-based gaming system. In various embodiments, as described above, one or more gaming machines 10 may be in communication with game server 330. In various embodiments, a memory device of game server 330 may store different games (e.g., first game 332 and/or second game 334), game programs, return percentages, and/or instructions, executable by a gaming machine processor (e.g., processor 110 in FIG. 1B), to control gaming machine 10. Each executable game program represents a different game, game version, or type of game which may be played on one or more of the gaming machines 10 in the gaming system. In various embodiments, an executable game program is for a first game and/or a second game.

In operation, the processor of the game server 330 is operable to communicate one or more of the stored game programs for one or more games to at least one gaming machine processor. In various embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the game server 330, the gaming machine processor executes the communicated program to facilitate play of the communicated program by a player through the display device(s) and/or input device(s) of the gaming machine. That is, when a game program is communicated to a processor of a gaming machine, the gaming machine processor changes the game or type of game played at the gaming machine.

While the embodiments described herein may be implemented using a game server of a casino management system, it should be recognized that the embodiments may alternatively be implemented on each gaming machine by the controller or processor 110 of that gaming machine.

Figure 4:
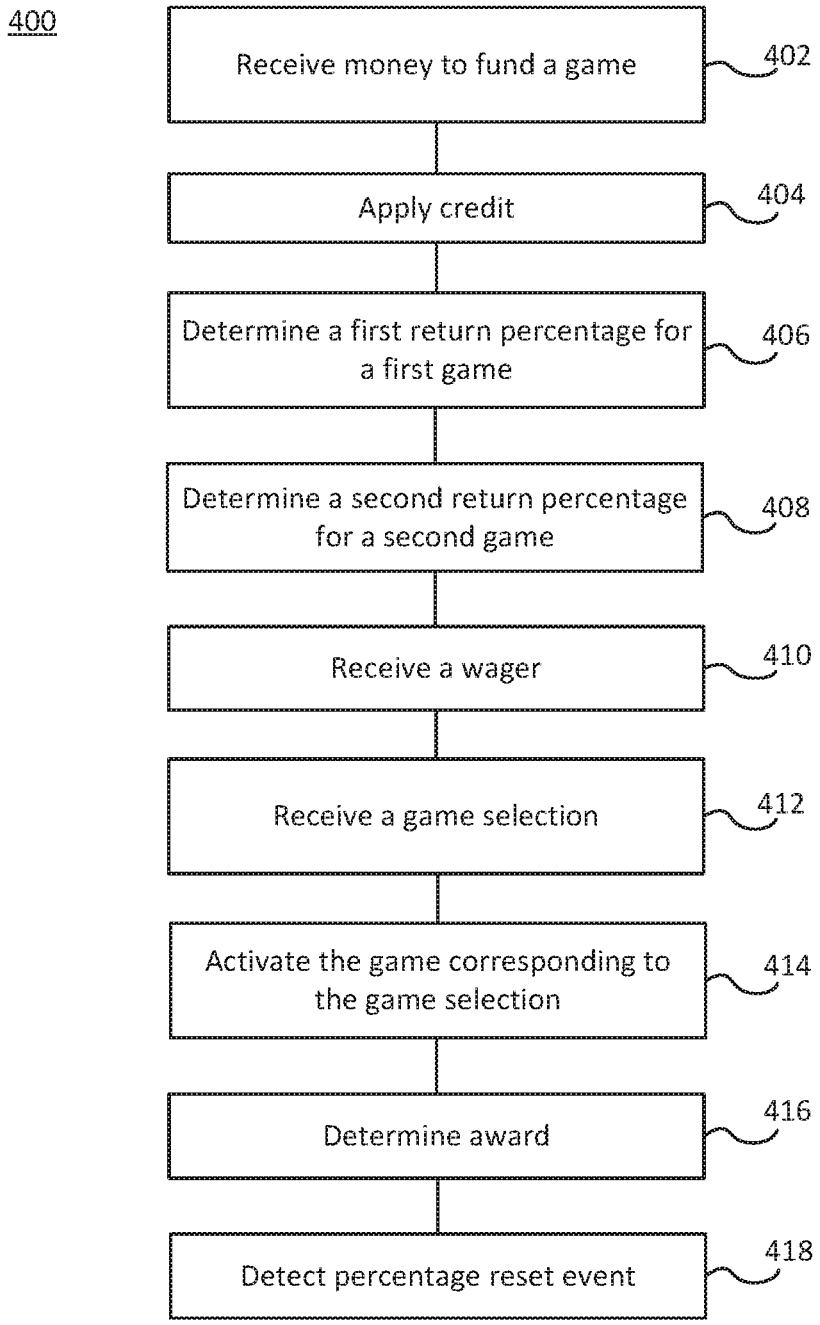
FIG. 4 depicts a method for operating a gaming system, in accordance with various embodiments.

In accordance with various embodiments, FIG. 4 depicts a method 400 for operating a gaming system. With combined reference to FIGS. 1A, 1B, and 4, the steps of method 400 may be performed by processor 110 and/or other components of gaming system 100, gaming machine 10, and/or game server 330 (in FIG. 3). In various embodiments, gaming system 100 may receive money to fund a game (step 402) on a gaming machine 10. The money may be cash inserted into gaming machine 10, or an electronic payment. In response to receiving the money to fund the game, gaming system 100 and/or gaming machine 10 may apply a credit (step 404). The player may use the applied credit to play a game on gaming system 100 and/or gaming machine 10.

As described herein, gaming system 100 and/or gaming machine 10 may comprise multiple games, such as first game 122 and second game 124. Gaming system 100 may have determined and/or an assigned a first return percentage for first game 122 (step 406), and a second return percentage for second game 124 (step 408) in response to an occurrence of a percentage reset event. In various embodiments, steps 406 and 408 may comprise selecting multiple games to present to a player, with at least two of the games having different return percentages. For example, determining a first return percentage for first game 122 (step 406) may comprise selecting a first game having a first return percentage, and determining a second return percentage for second game 124 (step 408) may comprise selecting a second game having a second return percentage, wherein the first return percentage and the second return percentage are different. The percentage reset event may have occurred before receiving money to fund the game (e.g., the end of the previous gaming session), or in response to receiving the money to fund a game or applying a credit. The first return percentage and the second return percentage may be different such that the player will have better odds of receiving a payout on whichever of first game 122 or second game 124 has the higher return percentage. First game 122 and second game 124 may be presented to the player for selection via a game selection device 146 for each game. In various embodiments in which gaming system 100 and/or gaming machine 10 offers more than two games to a player, gaming system 100 may determine a return percentage for each game, wherein at least two of the return percentages associated with at least two games available to the player are different. To play a game, the player may make a wager, and gaming system 100 and/or gaming machine 10 may receive the wager (step 410). In response, gaming system 100 and/or gaming machine 10 may subtract the wager amount from the credit available to the player to play games on gaming system 100 and/or gaming machine 10.

In various embodiments, the player may select a game on gaming system 100 and/or gaming machine 10 to play (e.g., between first game 122 and second game 124). If the player has already played multiple times on gaming system 100 and/or gaming machine 10, the player may have observed different payout amounts for each of first game 122 and second game 124, and therefore, may select a game based on the player's thought of which game has the higher return percentage. Gaming system 100 and/or gaming machine 10 may receive the game selection (step 412) from the player selecting a game through a game selection device 146 (e.g., game selection buttons 32A/32B and/or pull arms 33A/33B). In response, gaming system 100 and/or gaming machine 10 may activate the game corresponding to the game selection (step 414). The game may be activated in response to the player selecting a game selection device 146 (i.e., the game selection device may function to select and activate the desired game). For example, a player may select first game 122 by pulling pull arm 33A, through which gaming system 100 and/or gaming machine 10 receives the game selection and activates first game 122. In response to a play of the selected game ending, gaming system 100 and/or gaming machine 10 may determine an award (step 416) to the player, if any. If an award is due to the player (i.e., the player won some monetary amount), gaming system 100 and/or gaming machine 10 may dispense the money to the player, or apply the award as credit for the player's gaming session.

During a gaming session, any or all of the steps 402-416 may be repeated in any suitable order. For example, gaming system 100 and/or gaming machine 10 may detect a percentage reset event (step 418) (e.g., the player may hit a jackpot). In response, gaming system 100 and/or gaming machine 10 may again determine and/or assign a first return percentage for first game 122 (step 406) and a second return percentage for second game 124 (step 408) (i.e., reset the return percentages). Additionally, the player may play the games multiple times to continue the gaming session and the try to better observe which game provides the higher return percentage.

In various embodiments, at the end of a gaming session, gaming system 100 and/or gaming machine 10 may display results to show the player how many times, or for how long, he or she correctly selected the game with the higher return percentage.

Figure 5:
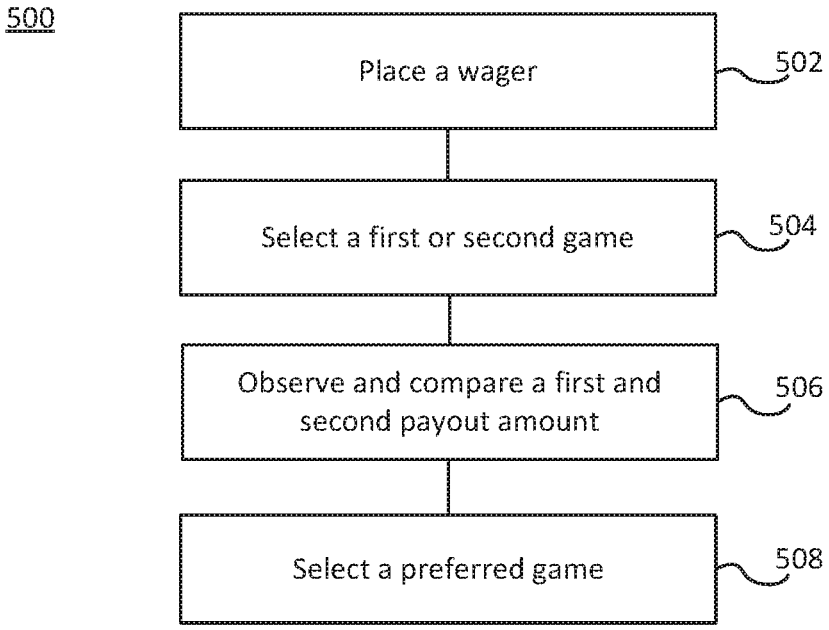
FIG. 5 depicts a method of playing a gaming system, in accordance with various embodiments.

In accordance with various embodiments, FIG. 5 depicts a method 500 for playing a gaming system. With combined reference to FIGS. 1A, 1B, and 5, a player may play a gaming system 100 and/or gaming machine 10, which may offer more than one game (e.g., two games: first game 122 and second game 124) to the player. The first game 122 may have a first return percentage, and the second game 124 may have a second return percentage, which may be different. The player may place a wager (step 502) by, for example, pressing wager button 31 and/or an intermediate wager button 30. The player may select a first game or a second game (step 504) (or any game out of multiple games available on gaming system 100 and/or gaming machine 10, which may be a choice of more than two games). The selected game may be activated and the player may receive an award for winning that play, or may not receive an award if the player did not win.

The player may play the games available on gaming system 100 and/or gaming machine 10 multiple times. The player, in response to playing the games multiple times, may have observed a payout amount each time the player won a play. Therefore, the player may have observed a first payout amount associated with first game 122 (which may be an observed average payout over all first game 122 plays) and a second payout amount associated with second game 124 (which may be an observed average payout over all first game 122 plays). Or, the player may observe a payout(s), such as those listed in payout column 202, for first game 122, and the same payout(s) for second game 124, and subsequently observe and analyze the frequency that the payout(s) occur between first game 122 and second game 124. By comparing specific payouts between games, a player may be able to determine which game of first game 122 and second game 124 has a higher payout percentage. For example, with brief reference to FIG. 2, a player may observe the payout amounts in payout column 202, and notice that first game 122 with first pay table 210 pays the 5-fold payout amount more frequently than second game 124 with second pay table 220 (as shown in payout row 205). In response, the player may select a preferred game (step 508), which may be the game the player perceives as having the higher return percentage based on the observed payout amounts.

In various embodiments, a player may repeat the steps of method 500 multiple times, adjusting which game is the preferred game based on payout amount observed over time. As discussed herein, gaming system 100 and/or gaming machine 10 may provide more than two games to play. In such a case, the player may select one of the multiple games to play (e.g., a third game having a third return percentage associated with it), and observe the multiple payout amounts to select a preferred game.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. In addition, various hardware components may be added to a gaming machine (such as gaming machine 10 depicted in FIG. 1A) allowing implementation of the embodiments discussed herein (e.g., buttons, levers, display screens, touch screens, and the like to allow presentation, display, and selection of different games on a gaming machine). It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A gaming system, comprising:

a processor; and a gaming machine in electronic communication with the processor, the gaming machine comprising a first game selection device, a second game selection device, and a display device, wherein the gaming machine allows a player to select a first game by selecting the first game selection device and allows the player to select a second game by selecting the second game election device, wherein the processor displays graphics for the first game and the second game on the display device simultaneously, wherein the first game and the second game share the same displayed graphics, wherein the first game and the second game are identical, except that the first game comprises a first return percentage, and the second game comprises a second return percentage, and the first return percentage and the second return percentage are different, and that the first game is associated with the first game selection device and the second game is associated with the second game selection device, and wherein the displayed graphics remain unaffected whether the player selects the first game selection device or the second game selection device.

2. The gaming system of claim 1, wherein the first game selection device activates the first game and the second game selection device activates the second game.

3. The gaming system of claim 1, further comprising a selector device configured to select at least one of the first game selection device or the second game selection device.

4. The gaming system of claim 1, wherein the gaming machine further comprises a third game selection device for selecting a third game having a third return percentage, wherein the gaming machine allows the player to select the third game by selecting the third game selection device, wherein the third return percentage is different than at least one of the first return percentage or the second return percentage.

5. The gaming system of claim 1, wherein the first game selection device is a first game selection button, and the second game selection device is a second game selection button.

6. The gaming system of claim 5, wherein the first game selection device and the second game selection device are provided by a touch screen on the gaming machine.

7. The gaming system of claim 1, wherein the first game selection device is a first pull arm, and the second game selection device is a second pull arm.

8. The gaming system of claim 1, wherein the first return percentage and the second return percentage remain the same during a gaming session.

9. The gaming system of claim 1, wherein the first return percentage and the second return percentage are configured to change in response to the occurrence of a percentage reset event.

10. A gaming system, comprising:

a gaming machine, comprising a cabinet, a display device, a first game selection device, and a second game selection device;

a processor operably coupled to the gaming machine; and a tangible, non-transitory memory configured to communicate with the processor, the tangible, non-transitory memory having instructions stored thereon that, in response to execution by the processor, cause the processor to perform operations comprising:

assigning, by the processor, a first return percentage associated with a first game and a second return percentage associated with a second game, wherein the first return percentage is higher than the second return percentage, wherein the first game and the second game are stored on the tangible, non-transitory memory, and wherein the first game and the second game are the same game;

displaying, by the processor, graphics for the first game and the second game on the display device simultaneously, wherein the first game and the second game share the same displayed graphics, and wherein the first game and the second game are identical except for the first game being associated with the first return percentage and the first game selection device and the second game being associated with the second return percentage and the second game selection device;

receiving, by the processor, a selection from a player of one of the first game or the second game, wherein the first game is selected by the first game selection device and the second game is selected by the second game selection device; and activating, by the processor, the first game in response to receiving a selection of the first game, or the second game in response to receiving a selection of the second game, wherein the displayed graphics remain unaffected whether the player selects the first game selection device or the second game selection device.

11. The gaming system of claim 10, wherein the first game selection device is a first game selection button, and the second game selection device is a second game selection button.

12. The game system of claim 10, wherein the first game selection device is a first pull arm, and the second game selection device is a second pull arm.

13. The game system of claim 10, wherein in the assigning the first return percentage and the second return percentage is completed randomly.

14. The gaming system of claim 10, wherein the operations further comprise:

detecting, by the processor, a percentage reset event; and resetting, by the processor, in response to the detecting the percentage reset event, at least one of the first return percentage or the second return percentage, wherein, after the resetting, the first return percentage and the second return percentage are different.

15. The gaming system of claim 14, wherein the percentage reset event is at least one of cashing the player out, a duration of time passing on the gaming machine, detecting a beginning of a gaming session, or awarding a reset payout amount.

* * * * *